United States Patent [19]

Gannon

[11] 4,006,014

[45] Feb. 1, 1977

[54] USE OF TETRAALKYLAMMONIUM HALIDES AS FLOTATION COLLECTORS

[75] Inventor: David John Gannon, St-Bruno, Canada

[73] Assignee: Canadian Industries Limited, Montreal, Canada

[22] Filed: Apr. 12, 1976

[21] Appl. No.: 675,763

[30] Foreign Application Priority Data

July 28, 1975 United Kingdom ..... 31540/75

[52] U.S. Cl. ..... 75/2; 209/166; 423/26

[51] Int. Cl.[2] ..... B03D 1/02; C22B 3/00

[58] Field of Search ..... 75/2, 117; 209/166, 209/167; 423/26, 37; 241/20; 252/61

[56] References Cited

UNITED STATES PATENTS

| | | | |
|---|---|---|---|
| 2,129,264 | 9/1938 | Downing et al. | 209/166 |
| 2,190,133 | 2/1940 | Epstein et al. | 209/166 |
| 2,214,352 | 9/1940 | Schoeller et al. | 209/166 |
| 2,993,867 | 7/1961 | Wilson | 252/61 |
| 3,006,471 | 10/1961 | Luttinger | 209/167 |
| 3,168,396 | 2/1965 | Barker | 75/117 |
| 3,321,649 | 5/1967 | Benedictis et al. | 209/166 |
| 3,728,430 | 4/1973 | Clitheroe et al. | 75/2 |
| 3,883,421 | 5/1975 | Cutting et al. | 75/2 |
| 3,976,565 | 8/1976 | Petrovich | 209/166 |

OTHER PUBLICATIONS

*Chemical Abstracts*, vol. 85, No. 2, American Chemical Society; Abstract No. 8502r, (1976).

*Chemical Abstracts*, vol. 84, No. 2, American Chemical Society; Abstract No. 9296t (1975).

*Chemical Abstracts*, vol. 82, No. 24, American Chemical Society; Abstract No. 158912b (1975).

*Chemical Abstracts*, vol. 78, No. 26, American Chemical Society; Abstract No. 161553h (1972).

*Primary Examiner*—L. Dewayne Rutledge
*Assistant Examiner*—Michael L. Lewis
*Attorney, Agent, or Firm*—Guy Drouin

[57] ABSTRACT

A process for the recovery of copper minerals from oxidized ores by flotation employing sulphidization of the oxidized minerals followed by flotation employing a tetraalkylammonium halide as collector. Preferably, a prior flotation step with a xanthate collector is employed, especially when the ore contains substantial amounts of unoxidized sulphide minerals. Using the preferred embodiment of the process it is possible to recover 10% more copper from an oxidized copper ore than is possible with sulphidization and xanthate flotation steps alone.

12 Claims, No Drawings

USE OF TETRAALKYLAMMONIUM HALIDES AS FLOTATION COLLECTORS

This invention relates to a process for the recovery of oxidized copper minerals from ores.

In the mining industry it is frequent practice to separate ore minerals from the commercially valueless fraction of the ore by a process of froth flotation. Froth flotation is commonly carried out using alkali metal xanthates as collectors. These are effective as collectors for sulphide minerals but have reduced effectiveness for the recovery of oxide or oxidized sulphide minerals. There thus is need for a froth flotation process that is applicable to oxide ores.

It has now been discovered that copper oxide and other oxidized copper minerals can be recovered after sulphidization by a froth flotation process employing as collector a tetraalkylammonium halide combined with an alkali metal fluoride as activator. The use of the novel flotation system results in a higher level of cooper recovery than is possible using conventional xanthate collectors.

Thus the principal object of the invention is to provide an improved process for the froth flotation recovery of copper minerals. Additional objects will appear hereinafter.

The process of the invention comprises the steps of 1. reducing an ore containing copper sulphide and oxidized copper minerals to a particle size suitable for froth flotation,
2. forming an aqueous pulp of said ore,
3. adding an alkali sulphide or alkali hydrosulphide to said aqueous pulp to sulphidize oxidized minerals,
4. adjusting the pH of the sulphidized aqueous pulp to a value in the range 5 to 11,
5. adding a tetraalkylammonium halide and a water soluble fluoride to the aqueous pulp, and
6. subjecting said aqueous pulp to froth flotation and separating the resultant copper bearing froth concentrate.

Preferably, the pH of the sulphidized aqueous pulp is adjusted in step (4) above to a value in the range 5 to 9.5.

It is preferred to combine flotation using a tetraalkylammonium halide collector with prior flotation steps employing an alkali metal xanthate collector, especially when the ore contains substantial amounts of unoxidized sulphide minerals. Thus a preferred embodiment of the invention comprises the steps of 1. reducing an ore containing oxidized copper minerals to a particle size suitable for froth flotation,
2. forming an aqueous pulp of said ore,
3. subjecting said aqueous pulp to froth flotation in the presence of an alkali metal xanthate and separating the resultant copper sulphide-bearing froth concentrate from a residual tailing,
4. adding an alkali sulphide or alkali hydrosulphide to the residual tailing to sulphidize oxidized minerals contained therein,
5. adding an alkali metal xanthate to said sulphidized tailing and subjecting said tailing to froth flotation and separating the resultant copper-bearing froth concentrate from a second residual tailing,
6. adjusting the pH of the second tailing to a value in the range 5 to 11.
7. adding a tetraalkylammonium halide and a water soluble fluoride to said tailing, and 8. subjecting said tailing to froth flotation and separating the resultant copper-bearing froth concentrate.

Preferably, the pH of the sulphidized aqueous pulp is adjusted in step (6) of the combined xanthate-tetraalkylammonium halide flotation process, described above, to a value in the range 5 to 9.5.

It is customary to reduce the particle size of the ore to the required degree by grinding in the presence of water. Then additional water is added to the ground ore to form a pulp suitable for froth flotation.

It has been found that higher copper recoveries can be obtained with oxidized ores containing free sulphides when the process combining both xanthate and tetraalkyl-ammonium halide water soluble fluoride flotation steps is employed than when only the tetraalkylammonium halide/water soluble fluoride flotation step alone is employed.

By oxidized copper minerals are meant minerals such as cuprite, malachite, azurite, chrysocolla and copper-iron silicates.

Suitable tetraalkyaalkylammonium collectors comprise tetrabutylammonium chloride, tetrapropylammonium iodide, tetrapentylammonium iodide, and cetyltrimethyl-ammonium bromide.

Suitable fluoride activators comprise sodium fluoride and potassium fluoride.

Suitable alkali metal xanthate collectors are sodium ethyl xanthate, sodium propyl xanthate, sodium isopropyl xanthate, sodium butyl xanthate, sodium isotubyl xanthate, sodium sec-butyl xanthate, sodium amyl xanthate, sodium isoamyl xanthate, sodium hexyl-xanthate and the corresponding potassium compounds.

The tetraalkylammonium halide collector is employed in proportions of 0.1 to 2.0 pounds per ton of ore and preferably 0.3 to 2.0 pounds per ton of ore. The fluoride activator preferably is employed in proportions of 0.25 to 1.0 pounds per ton or ore. The alkali metal xanthate collector preferably is employed in proportions of 0.2 to 0.4 pounds per ton of ore. The sulphidizing agent, e.g. sodium hydrosulphide preferably is employed in proportions of 4.0 to 10.0 pounds per ton of ore.

The tetraalkylammonium halide collector is employed with pulp maintained at a pH in the range 5 to 9.5.

During froth flotation employing an alkali metal xanthate collector it is desirable to use a frother such as pine oil, cresylic acid, higher alcohols or polyglycol ethers. The frother preferably is employed in proportions of 0.01 to 0.15 pounds per ton of ore.

Before flotation ore must be reduced to particle size suited to froth flotation by grinding and classification. It is customary to carry out the grinding of ore in the presence of water. A pulp density suitable for grinding is about 60% solids. Additional water is then added to the ground ore prior to flotation. A size suitable for froth flotation is minus 35 mesh and preferably minus 50 mesh or minus 60 mesh. A pulp density suitable for flotation is 25% to 45% solids. Flotation is carried out in known flotation machines.

After the collector is added to the aqueous ore pulp it is preferred to condition the pulp for a few minutes before commencing froth flotation.

By the use of the preferred embodiment of this invention it is possible to recover about 10% more copper from an oxidized copper ore than is possible with the prior art procedure of sulphidization and flotation with an xanthate collector.

The invention is additionally illustrated by the following examples but its scope is not limited to the embodiments shown therein.

EXAMPLE 1

An oxidized copper ore from the Gaspe area of the Province of Quebec, Canada, containing a copper-iron silicate accompanied by chalcopyrite and malachite enclosed within a coating of the silicate as well as free chalcopyrite and malachite, about 50% of the copper being present in the oxidized component of the ore, was subjected to froth flotation to concentrate the copper minerals. THe copper-iron silicate assayed by electron microprobe analysis was found to contain 12% CuO, 58% FeO and 15% $SiO_2$. The ore contained 0.75% copper.

The ore was ground with water at a pulp density of 60% solids so that 90% of the ore passed a 200 mesh Tyler screen. Additional water was then added to form a pulp containing 25% solids. The ore was treated in a three stage flotation process employing a 500 gram capacity flotation cell. In the first stage potassium amyl xanthate in the amount of 0.15 pounds per ton of ore was added to the pulp which was conditioned for 5 minutes. The pulp was then floated for 5 minutes and the copper concentrate recovered. In the second stage the pulp from the first stage was conditioned for 15 minutes with sodium hydrosulphide (NaHS) in the amount of 5 pounds per ton of ore. Then potassium amyl xanthate in the amount of 0.15 pounds per ton of ore was added and the pulp conditioned for 5 minutes. The pulp was then floated for 5 minutes and the copper concentrate recovered. In the first and second stages 62% of the total copper in the ore was recovered.

The pulp from the second stage was then conditioned for 5 minutes with a tetraalkylammonium halide collector and a sodium fluoride activator and then floated for 5 minutes. Several portions of the pulp were floated using different tetraalkylammonium halide collectors. The characteristics of the third stage concentrates are shown in the accompanying table.

It has been found that lowering the pH to a value of 5 improves the copper grade in the third stage with only a small reduction in copper recovery. Below a pH value of 5 both the copper grade and the recovery decrease.

A third stage concentrate of the above Gaspe ore, assaying 3.0% Cu, obtained using 1.0 pound per ton of tetrabutylammonium chloride with 0.5 pound per ton of sodium fluoride, was cleaned in a 500 gram flotation cell without addition of further reagents. This single stage cleaning yielded a concentrate containing 6.0% Cu.

TABLE

| Collector | Collector Dosage lb/ton | NaF Dosage lb/ton | pH | Additional Recovery of Copper in 3rd Stage % of Total Copper in Ore | Grade of 3rd Stage Copper Concentrate % Copper |
|---|---|---|---|---|---|
| Tetrabutylammonium chloride | 2.0 | | 5 | 11.4 | 1.9 |
| Tetrabutylammonium chloride | 2.0 | 0.5 | 5 | 13.6 | 1.3 |
| Tetrabutylammonium chloride | 1.0 | 0.5 | 5 | 12.5 | 2.7 |
| Tetrabutylammonium chloride | 1.0 | 0.3 | 5 | 12.0 | 2.7 |
| Tetrabutylammonium chloride | 1.0 | 1.0 | 5 | 13.6 | 2.2 |
| Tetrabutylammonium chloride | 1.0 | 0.5 | 9.5 | 15.4 | 1.4 |
| Tetrabutylammonium chloride | 0.5 | 0.5 | 5 | 6.8 | 3.1 |
| Tetrabutylammonium chloride | 1.0 | 0.5 | 4 | 10.7 | 2.5 |
| Tetrapropylammonium iodide | 1.0 | 0.5 | 5 | 5.1 | 2.6 |
| Tetrapentylammonium iodide | 1.0 | 0.5 | 5 | 11.0 | 2.5 |
| Cetyltrimethylammonium bromide | 2.0 | | 5 | 9.2 | 1.3 |
| Cetyltrimethylammonium bromide | 2.0 | 0.5 | 5 | 14.7 | 1.2 |

It can be seen that the use of the tetraalkylammonium halide collector permits a significant increase in the recovery of oxidized copper minerals.

EXAMPLE 2

An oxidized copper ore from the Bethlehem mine in the Highland Valley area of British Columbia, Canada, of the same type as that of Example 1 with the copper-iron silicate assaying by electron microprobe analysis: 8% Cuo, 20% FeO and 18% $SiO_2$, about 70% of the copper being present in the oxidized component of the ore, was subjected to a three stage froth flotation sequence to concentrate copper minerals. The ore contained 0.56% copper.

The ore was ground with water at a pulp density of 60% solids so that 89% of the ore passed a 200 mesh Tyler screen. Additional water was then added to form a pulp containing 25% solids. The details of the three stage sequence are as follows:

| | |
|---|---|
| Stage 1: | 0.20 lb. per ton of sodium amyl xanthate<br>Conditioned 5 minutes; floated 5 minutes |
| Stage 2: | 10 lb. per ton of sodium hydrosulphide (NaHS)<br>Conditioned 15 minutes<br>0.2 lb. per ton of sodium amyl xanthate<br>Conditioned 5 minutes; floated 5 minutes<br>Stages 1 and 2 recovered 41% of the copper. |
| Stage 3: | 1.0 lb. per ton tetrabutylammonium chloride<br>0.5 lb. per ton sodium fluoride; pH 5<br>Conditioned 5 minutes; floated 5 minutes<br>Additional recovery of copper 35%<br>(Total recovery 76% copper)<br>Grade of Stage 3 copper concentrate: 1.1% copper. |

EXAMPLE 3

An oxidized copper ore from the Lornex mine in the Highland Valley area of British Columbia, Canada of the same type as that of Example 1 the oxidized component comprising about 100% of the ore, was subjected to a three stage froth flotation sequence to concentrate copper minerals. The ore contained 0.35% copper.

The ore was ground with water at a pulp density of 60% solids so that 75% of the ore passed a 200 mesh Tyler screen. Additional water was then added to form a pulp containing 25% solids. The details of the three stage sequence are as follows:

| | |
|---|---|
| Stage 1: | 0.2 lb. per ton sodium amyl xanthate<br>Conditioned 5 minutes; floated 5 minutes |
| Stage 2: | 10 lb. per ton sodium hydrosulphide (NaHS)<br>Conditioned 15 minutes<br>0.2 lb. per ton sodium amyl xanthate<br>Conditioned 5 minutes; floated 5 minutes<br>Stages 1 and 2 recovered 56% of the copper. |
| Stage 3: | 0.5 lb. per ton tetrabutylammonium chloride<br>0.5 lb. per ton sodium fluoride; pH 5<br>Conditioned 5 minutes; floated 5 minutes<br>Additional recovery of copper 27%<br>(Total recovery 83% copper)<br>Grade of Stage 3 copper concentrate: 1.7% copper. |

EXAMPLE 4

500 grams of the ore from the Bethlehem mine, described in Example 2 was ground with water at a pulp density of 60% solids so that 89% of the ore passed a 200 mesh Tyler screen. Additional water was then added to form a pulp containing 25% solids. Sodium hydrosulphide in an amount equivalent to 5.0 pounds per ton of ore was added and the pulp was conditioned for 5 minutes. Tetrabutylammonium chloride in amount equivalent to 0.3 pound per ton and sodium fluoride in amount equivalent to 0.12 pound per ton were added and the pulp was conditioned for 5 minutes and then floated for 5 minutes in a 500 gram capacity flotation cell. A recovery of 43% Cu at 16.3% Cu grade was obtained.

When the same pulp was floated using potassium amyl xanthate in an amount equivalent to 0.4 pound per ton in place of the tetrabutylammonium chloride/-sodium fluoride mixture a recovery of 37% Cu at 5.5% grade was achieved.

What we claim is:

1. A process for the recovery of copper minerals from oxidized copper ores comprising the steps of 1. reducing an ore containing copper sulphide and oxidized copper minerals to a particle size suitable for froth flotation,
2. forming an aqueous pulp of said ore,
3. adding an alkali metal sulphide or an alkali metal hydrosulphide to said aqueous pulp to sulphidize oxidized minerals,
4. adjusting the pH of the sulphidized aqueous pulp to a value in the range 5 to 11,
5. adding a tetraalkylammonium halide and a water soluble fluoride to the aqueous pulp, and
6. subjecting said aqueous pulp to froth flotation and separating the resultant copper-bearing froth concentrate.

2. A process as claimed in claim 1 wherein the Ph of the sulphidized aqueous pulp is adjusted in step (4) to a value in the range 5 to 9.5.

3. A process as claimed in claim 1 wherein prior to the step (3) addition of alkali metal sulphide or hydrosulphide the aqueous pulp is subjected to froth flotation in the presence of an alkali metal xanthate with separation of the resultant copper sulphide-bearing froth concentrate from a residual tailing, the alkali metal sulphide or hydrosulphide of step (3) then being added to the residual tailing from said xanthate flotation.

4. A process as claimed in claim 1 wherein the tetraalkylammonium halide is a member selected from the group consisting of tetrabutylammonium chloride, tetrapropylammonium iodide, tetrapentylammonium iodide and cetyltrimethylammonium bromide.

5. A process as claimed in claim 1 wherein the tetraalkylammonium halide is employed in proportions of 0.1 to 2.0 pounds per ton of ore.

6. A process as claimed in claim 1 wherein the tetraalkylammonium halide is employed in proportions of 0.3 to 2.0 pounds per ton of ore.

7. A process as claimed in claim 1 wherein the water soluble fluoride is sodium fluoride or potassium fluoride.

8. A process as claimed in claim 1 wherein the water soluble fluoride is employed in proportions of 0.25 to 1.0 pounds per ton of ore.

9. A process as claimed in claim 1 wherein the alkali metal hydrosulphide is sodium hydrosulphide.

10. A process as claimed in claim 1 wherein the alkali metal sulphide or alkali metal hydrosulphide is employed in proportions of 4.0 to 10.0 pounds per ton of ore.

11. A process as claimed in claim 2 wherein the alkali metal xanthate is sodium amyl xanthate.

12. A process as claimed in claim 2 wherein the alkali metal xanthate is employed in proportions of 0.2 to 4.0 pounds per ton of ore.

* * * * *